US008056451B2

(12) United States Patent
Chervenak et al.

(10) Patent No.: US 8,056,451 B2
(45) Date of Patent: Nov. 15, 2011

(54) LOCKING PLIERS

(75) Inventors: Thomas M. Chervenak, Stanley, NC (US); David P. Engvall, Stanley, NC (US)

(73) Assignee: Irwin Industrial Tool Company, Huntersville, NC (US)

( * ) Notice: Subject to any disclaimer, the term of this patent is extended or adjusted under 35 U.S.C. 154(b) by 211 days.

(21) Appl. No.: 12/496,385

(22) Filed: Jul. 1, 2009

(65) Prior Publication Data

US 2010/0018361 A1 Jan. 28, 2010

Related U.S. Application Data

(63) Continuation-in-part of application No. 12/180,836, filed on Jul. 28, 2008, now Pat. No. 7,861,622.

(60) Provisional application No. 61/114,249, filed on Nov. 13, 2008.

(51) Int. Cl.
*B25B 7/12* (2006.01)
*B25B 7/14* (2006.01)

(52) U.S. Cl. ..... 81/367; 81/318

(58) Field of Classification Search ..... 81/315, 81/318, 324, 349, 364, 367, 372–380, 383.5, 81/405, 418, 419, 186
See application file for complete search history.

(56) References Cited

U.S. PATENT DOCUMENTS

| | | | | | |
|---|---|---|---|---|---|
| 2,388,580 | A * | 11/1945 | Snell | 81/377 |
| 2,519,630 | A | 8/1950 | Boyer et al. | |
| 2,854,877 | A * | 10/1958 | Hunt | 81/383.5 |
| 2,857,795 | A * | 10/1958 | Workman | 81/351 |
| 3,710,658 | A * | 1/1973 | Wilson | 81/367 |
| 5,056,385 | A * | 10/1991 | Petersen | 81/370 |
| 5,456,144 | A * | 10/1995 | Dahl et al. | 81/373 |
| 6,311,588 | B1 * | 11/2001 | St. John et al. | 81/409 |
| 6,341,545 | B1 * | 1/2002 | Gomas | 81/300 |
| 6,378,404 | B1 * | 4/2002 | Bally et al. | 81/355 |
| 2003/0196526 | A1 * | 10/2003 | Wang | 81/367 |
| 2007/0131068 | A1 * | 6/2007 | McNatt | 81/367 |

FOREIGN PATENT DOCUMENTS

| | | |
|---|---|---|
| EP | 0216717 A | 4/1987 |
| FR | 2218971 A | 9/1974 |
| JP | S49-116699 | 11/1974 |
| WO | 9518699 A1 | 7/1995 |

OTHER PUBLICATIONS

European Search Report, Oct. 29, 2009.
Australian Patent Office; Examination Report; Aug. 18, 2010; issued in Australian Patent Application No. 2009203036.
Chinese Patent Office; Office Action; Apr. 15, 2011; issued in Chinese Patent Application No. 200910159067.9.
Korean Patent Office; Office Action; Apr. 22 2011; issued in Korean Patent Application No. 2009-66239.

* cited by examiner

*Primary Examiner* — David B Thomas
(74) *Attorney, Agent, or Firm* — Dennis J. Williamson; Moore & Van Allen, PLLC

(57) ABSTRACT

The pliers comprise a fixed assembly and a second jaw movable relative to the first jaw between an open position and a closed, locked position. A movable pivot connects the second jaw to the fixed assembly such that the movable pivot can move relative to the fixed assembly when the second jaw is in the closed, locked position and a torque is applied to the pliers. The second jaw is configured such that a resultant force on the second jaw is inside of the fixed pivot, between the fixed pivot and the movable pivot.

17 Claims, 7 Drawing Sheets

LOCKING PLIERS

This application claims benefit of priority under 35 U.S.C. §119(e) to the filing date of to U.S. Provisional Application No. 61/114,249 as filed on Nov. 13, 2008, which is incorporated herein by reference in its entirety and is a continuation-in-part of prior application Ser. No. 12/180,836, filed Jul. 28, 2008.

FIELD OF THE INVENTION

This invention relates generally to locking pliers and, more particularly, to a locking pliers having an improved grip on the work piece.

BACKGROUND

Pliers-type hand tools with toggle-locking mechanisms are generally known as locking pliers. These pliers usually comprise a fixed handle having a fixed jaw on one end thereof. A movable handle pivots a movable jaw relative to the fixed handle to open and close the jaws. To grip a workpiece the handles are tightly compressed such that the linkage of the toggle-locking mechanism locks the pliers onto the workpiece. Adjustments in the force applied by the jaws to the workpiece are generally made by turning an adjusting screw mounted in the fixed handle that engages the toggle locking mechanism. The adjusting screw is translated relative to the fixed handle to modify the physical dimensions of the toggle mechanism to vary the effective length of the linkage of the toggle-locking mechanism. This adjustment varies the distance between the ends of the toggle linkage to vary the force applied by the jaws to the workpiece when the tool is locked. The pliers will remain firmly locked in place without the continuous application of force by the user.

SUMMARY OF THE INVENTION

One embodiment of the lockable pliers comprises a fixed assembly comprising a first handle supporting a first jaw and a second jaw movable relative to the first jaw between an open position and a closed, locked position. A second handle moves relative to the first handle and is connected to the second jaw at a fixed pivot. A locking mechanism locks the second jaw in the closed, locked position. A movable pivot connects the second jaw to the fixed assembly such that the movable pivot can move relative to the fixed assembly when the second jaw is in the closed, locked position and a torque is applied to the pliers. As a result, the jaws tighten the grip on the workpiece versus a tool without this jaw movement. The second jaw is configured such that a resultant force on the second jaw is inside of the fixed pivot, between the fixed pivot and the movable pivot. The second jaw is formed as a V-shape where the second jaw has a first jaw face and a second jaw face arranged at an angle relative to one another. The first jaw face and second jaw face are configured such that when the tool is locked on a workpiece the first jaw face does not contact the workpiece and the second jaw face contacts the work piece during the torquing of the tool.

DETAILED DESCRIPTION OF EMBODIMENTS OF THE INVENTION

Figure 1:
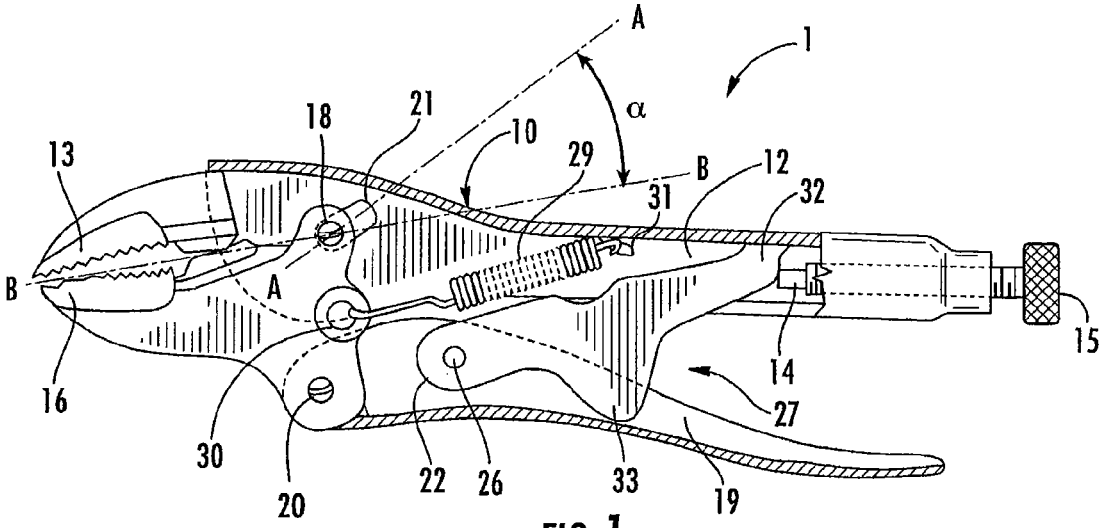
FIG. 1 is a partially cut-away side view of one embodiment of a locking pliers according to the present invention with the aperture in the fixed assembly in the nearly closed and locked position.

Pliers 1 include a fixed assembly 10 having a fixed handle 12 at one end and a fixed jaw 13 at the other end. A movable handle 19 is pivotably connected at one end to a movable jaw 16 by pivot pin 20. The jaws may have any shape where the tight grip function of the invention is useful.

A pivot pin 18 is fixed in position on the movable jaw 16 and connects the movable jaw 16 to the fixed assembly 10. The fixed assembly 10 includes a slotted aperture 21 for receiving the pivot pin 18 such that the pivot pin 18 can move in slotted aperture 21 to increase the gripping force exerted on a work piece during use of the pliers as will hereinafter be described. Thus, the movable jaw 16 rotates about an axis of rotation that extends through the axis of pin 18 and the axis of rotation can move in the aperture 21 as will hereinafter be described. The slotted aperture 21 has the shape of an elongated oval hole where the long axis of the aperture A-A extends generally towards the rear of the pliers and is disposed such it is arranged at an angle $\alpha$ where angle $\alpha$ is the angle between the long axis A-A of the aperture 21 and a line B-B that extends through the center of the closed jaws. The angle $\alpha$ can be varied to thereby change the spacing between jaws 13 and 16 at which the maximum gripping force is applied. In one embodiment angle $\alpha$ is approximately 15°. The pin 18 is dimensioned such that it is constrained to move substantially along the long axis A-A of the aperture 21. As used herein, "front" or "frontward" means generally toward jaws 13 and 16 and "rear" or "rearward" means generally toward handles 12 and 19. While the aperture 21 is described as a slotted aperture, the aperture 21 can have a different shape than the aperture illustrated in the figures provided the shape allows the pivot pin 18 to move such that the movable jaw 16 moves toward the fixed jaw 13. An alternate shape for aperture 21 is arcuate where the center of the arc of the aperture is located at pin 20.

A toggle locking mechanism 27 locks the fixed jaw 13 relative to the movable jaw 16. A link 22 is pivotably connected to the movable handle 19 by a pivot pin 26. The opposite end 32 of link 22 is in sliding and pivoting contact with the end of adjustment screw 14. A projection 33 extends transversely to the length direction of the link 22 and acts as a stop when the jaws are in the closed position by making contact with the handle 19. A biasing spring 29 extends between an opening 30 on the movable jaw 16 to a tab 31 protruding from fixed handle 12. The spring 29 applies a bias which tends to move the jaws 13 and 16 away from one another.

When the jaws 13 and 16 are in the open position, the pivot points, 18, 20, 26 and the point of contact between the end 32 of link 22 with the end of the adjusting screw 14 are arranged as a polygon. When the jaws are in the closed position, the pivots 20, 26 and the point of contact between link 22 and screw 14 are substantially in a straight line with the pin 26 in an over-center position where it is positioned slightly inside (toward fixed assembly 10) of the line between pivot 20 and the point of contact between link 22 and the screw 14. The jaws 13 and 16 cannot be pried apart from the locked position by use of force which pulls or pushes on the jaws 13 and 16 because separation of the jaws is prevented by the over-center condition of the pin 26. However, the jaws 13 and 16 may be separated by applying a force to the movable handle 19 in a direction which moves the movable handle 19 away from the fixed handle 12. A configuration of the pivots which places the mechanism in a locked position when the jaws are closed or grasping a workpiece can be considered an over-center mechanism when force applied directly to the jaws is not effective in separating the jaws. The jaws can only be opened by forces acting on the links of the mechanism. Other locking mechanisms are known and may also be used to lock the handles relative to one another. For example, the linkage may include a release lever to facilitate the unlocking of the links and/or the locking mechanism may include a compound linkage for effecting the locking function.

The end of the fixed handle 12, remote from the jaw 13, is completed with a threaded circular aperture through which threaded adjustment screw 14 is threadably engaged. The screw 14 terminates in an adjusting knob or head 15. The end 32 of the link 22 is slidably and pivotably engaged with the end of the adjusting screw 14. As is apparent from the drawing, turning the adjusting screw 14 changes the distance between the end 32 of the link 22 and the pivot point 18 of the movable jaw 16, whereby the jaws may be adjusted to grip objects of different dimensions with varying force.

Figure 2:
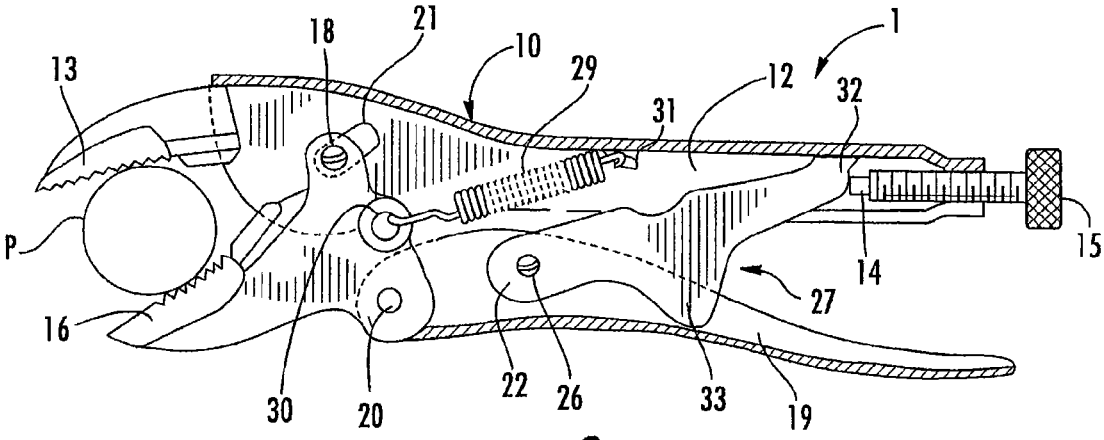
FIG. 2 is a partially cut-away side view of an embodiment of a locking pliers according to the present invention in its closed, locked position on a workpiece.

The operation of the locking pliers will be explained with reference to the figures. The locking pliers are shown locked on a work piece P (FIG. 2) such as a pipe although the pliers will operate in a similar fashion for a variety of shaped and sized work piece. In the locked position, the jaws tightly engage the work piece P and the toggle locking mechanism 27 is in the locked, over-center position where the pliers maintain the locked position without the application of force by the user. In existing locking pliers, when a torque or turning force is applied to the pliers, the jaws can lose purchase and "slip" over the work piece.

Figure 4:
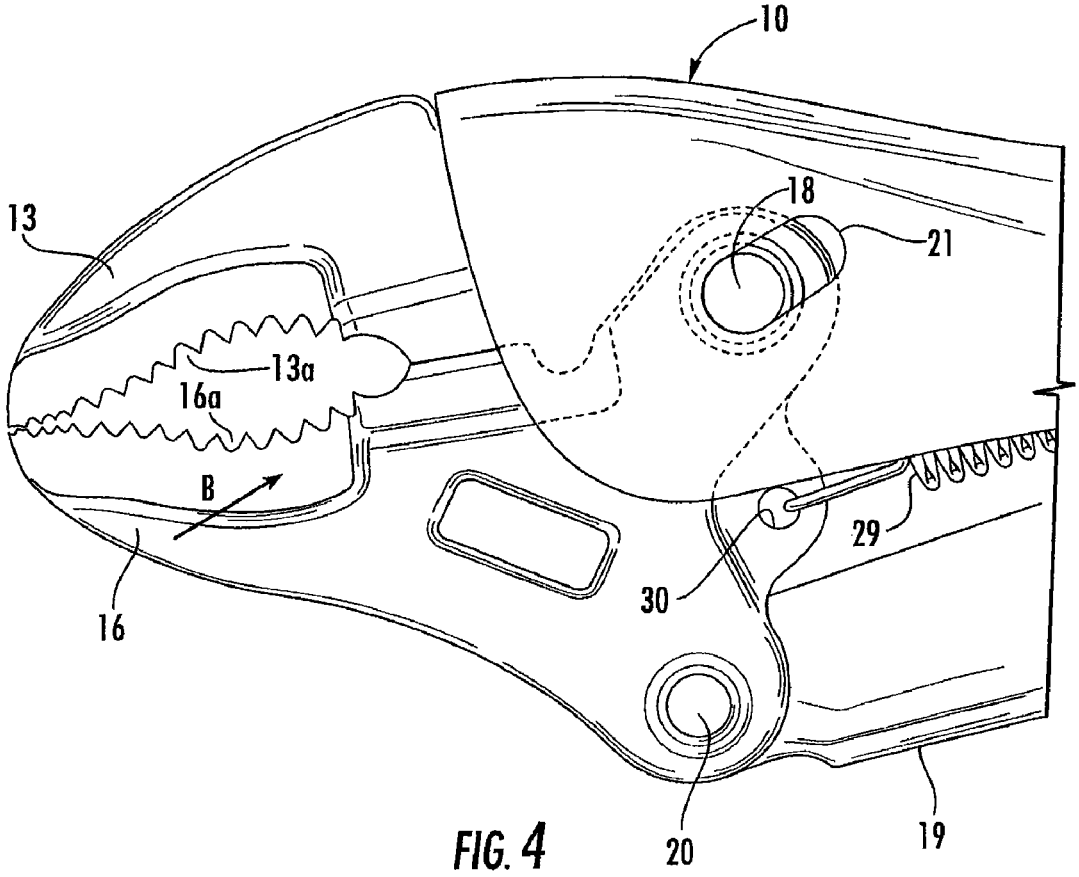
FIG. 4 is a more detailed side view of the pliers of FIG. 1.

In operation of the pliers of the invention, when the jaws are not locked on a work piece, the spring 29 pulls the movable jaw 16 slightly rearward such that the pin 18 is at the rear end of aperture 21 and the jaws of the pliers have a slight overbite. When the pliers are first locked on a work piece (or if the jaws are clamped against one another as shown in FIG. 4), jaw 16 moves frontward such that the pivot pin 18 moves in aperture 21 towards the front of the pliers and to the front of aperture 21. When a turning force or torque is applied to the pliers in the direction of arrow A, the arrangement of pivot pin 18 in aperture 21 allows the movable jaw 16 to move toward the rear of the pliers and toward the fixed jaw. The movable jaw 16 rotates slightly around pivot pin 20 (clockwise as viewed in the figures) and pivot pin 18 moves toward the rear of aperture 21. The movable jaw 16 and pivot pin 18 move in the same direction. As the movable jaw 16 rotates about pin 20 it moves rearward and toward the fixed jaw 13. As the movable jaw 16 moves toward the fixed jaw 13, the gripping force on the work piece increases as the distance between the jaws (or the volume of the space between the jaws) decreases. To increase the gripping effect of the pliers, the gripping faces 13*a* and 16*a* are configured such that the distance between the jaws becomes smaller toward the front of the pliers. As a result, as the jaw 16 rotates, the distance between the jaws also narrows due to the geometry of the jaws as well as the movement of jaw 16 toward jaw 13. Such an arrangement can be used with any of the embodiments of the invention.

Figure 3:
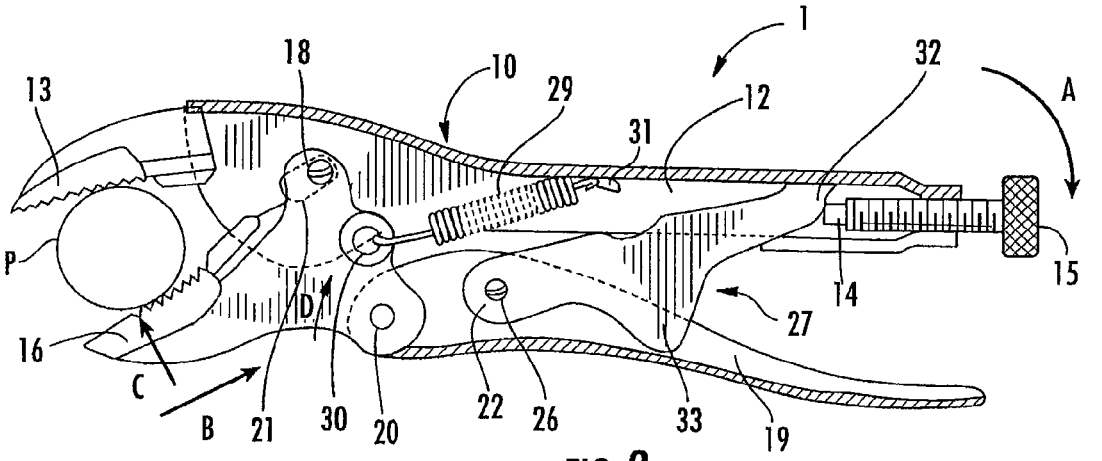
FIG. 3 is a partially cut-away side view of an embodiment of a locking pliers according to the present invention in its closed, locked position on a workpiece with a turning force applied to the pliers.

When the jaws 13 and 16 are closed and locked on a work piece and a turning force is applied in the direction of arrow A (FIG. 3), the pivot pin 18 tends to move toward the rear of aperture 21. As the pivot pin 18 moves in aperture 21, the movable jaw 16 also rotates about pin 20 as shown by arrow D. The rotation of jaw 16 results in the movement of jaw 16 slightly rearward as represented by arrow B. As the movable jaw 16 moves a component of the movement of movable jaw 16 is toward fixed jaw 13 in the direction of arrow C. As the movable jaw 16 moves rearward, the angle of aperture 21 forces the movable jaw 16 toward the fixed jaw 13 such that the gripping force exerted on the work piece P is increased as the turning force applied to the pliers increases. As a result, the pliers resist slipping on the work piece at higher applied torques.

Figure 5:
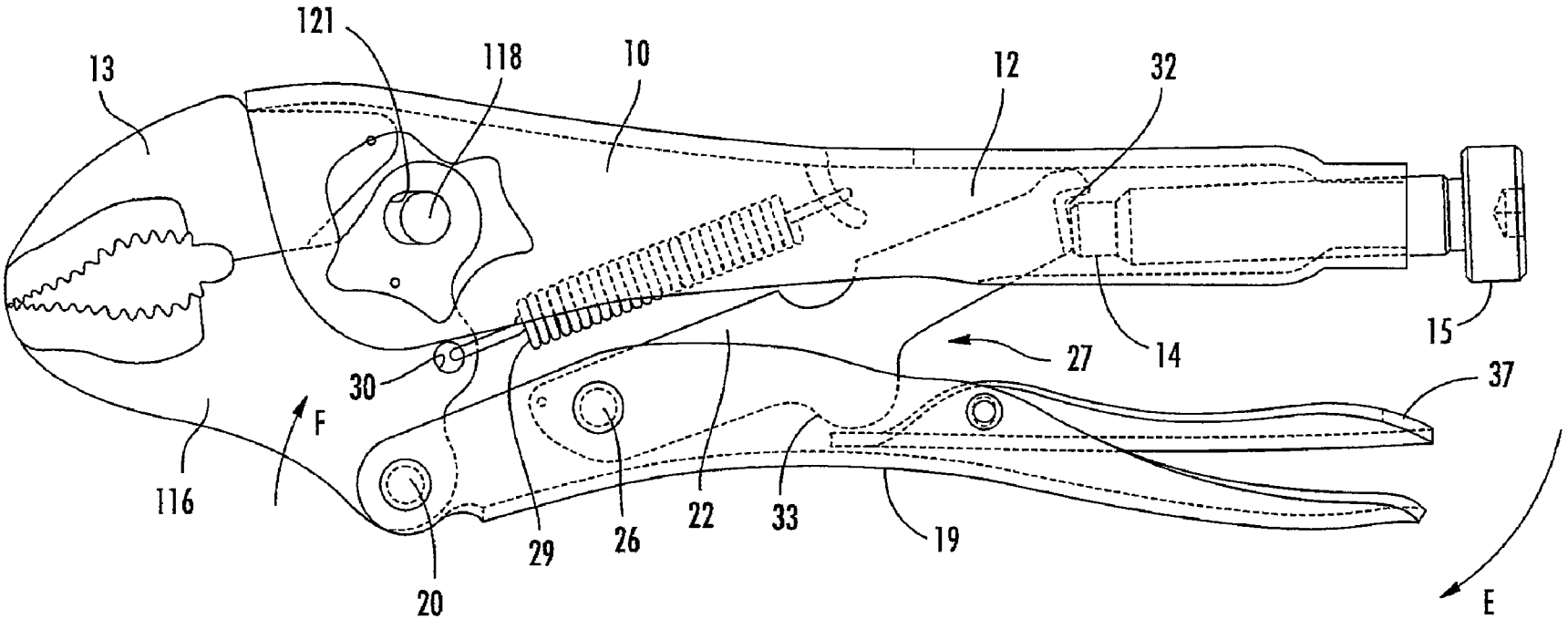
FIG. 5 is a partially cut-away side view of another embodiment of the pliers with the aperture for the movable pivot in the movable jaw instead of the fixed assembly.

In another embodiment shown in FIG. 5, the pivot pin 118 is retained in a fixed position relative to the fixed assembly 10 and a slotted aperture 121 is formed in the movable jaw 116 and receives pivot pin 118. The embodiment of FIG. 5 reverses the placement of the aperture and pin on the fixed assembly 10 and movable jaw from the embodiment of FIGS. 1 through 4. While the aperture 121 is described as a slot, the aperture 121 can have a different shape than the slot illustrated in the figures provided the shape allows the pivot pin to move such that the movable jaw moves toward the fixed jaw. In this embodiment, when the pliers are not locked on a work piece the spring 29 pulls the movable jaw 116 rearward such that the pin 118 is at the front end of aperture 121 and the jaws of the pliers have a slight overbite. When the pliers are first locked on a work piece (or are tightly closed against one another as shown in FIG. 5) the movable jaw 116 having aperture 121 moves forward such that the rear end of aperture 121 is at the pin 118. The movable jaw 116 can rotate around pivot pin 20 in the direction of arrow F (clockwise as viewed in FIG. 5) to allow movement of aperture 121 (and jaw 116) relative to stationary pivot pin 118. The movable jaw 116 moves rearward and toward the fixed jaw 13. As the movable jaw 116 moves toward the fixed jaw 13, the gripping force on the work piece increases as the distance between the jaws (or the volume of the space between the jaws) decreases.

When the jaws 13 and 116 are closed and locked on a work piece and a turning force is applied in the direction of arrow E, jaw 116 moves rearward and towards jaw 13 as aperture 121 moves relative to pivot pin 118 (the front of aperture 121 moves toward pin 118). As the jaw 116 moves, the aperture 121 allows the movable jaw 116 to move toward the fixed jaw 13 as it rotates in the direction of arrow F about pin 20 such that the gripping force exerted on the work piece P is increased as the turning force applied to the pliers increases. As a result, the pliers resist slipping on the work piece at higher applied torques. As the jaw 116 moves rearward, the distance between the jaws narrows due to the geometry of the jaws as well as the movement of jaw 116 toward jaw 13.

In the embodiments shown in FIGS. 1 through 5 a slotted aperture 21, 121 is shown that allows movement of the pin 18 relative to the fixed assembly 10. However, the aperture may have any shape that allows movement of the movable jaw 16 relative to the fixed jaw 13 when the pliers are locked on a work piece and a torque is applied to the pliers. The aperture may have any shape provided sufficient clearance is provided to allow movement of the movable jaw 16 toward the fixed jaw 13. For example, slotted aperture 21 or 121 may be replaced by a circular aperture provided that the aperture is sized to provide clearance between the front and rear ends of the aperture and the pin 18 to allow movement of the pin 18 relative to the aperture. Because jaws 16, 116 pivot about pin 20, the clearance between the aperture 21, 121 and the pin 18, 118 must allow the jaws 16, 116 to pivot about pin 20.

Figure 6:
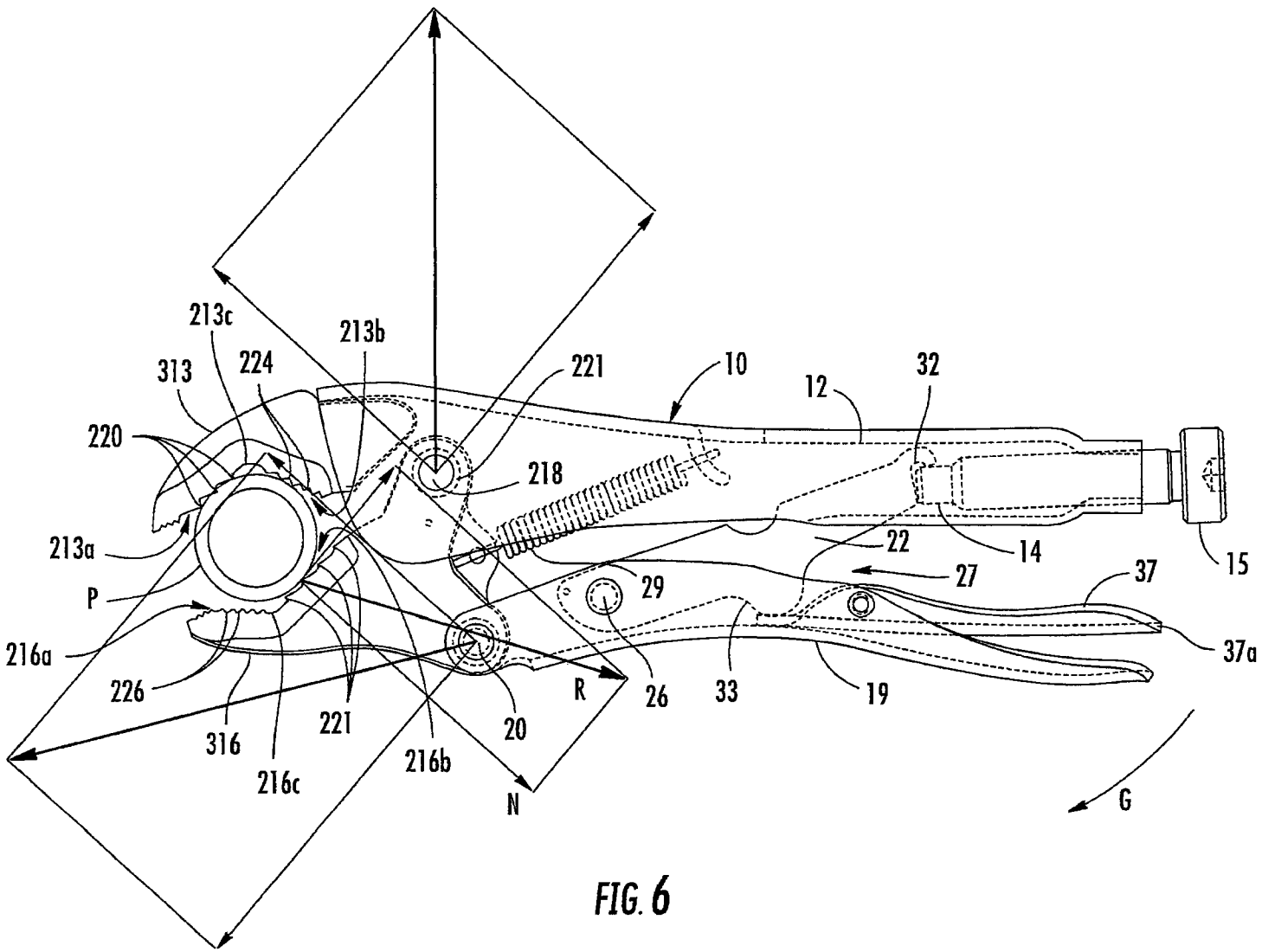
FIG. 6 is a side view of an alternate embodiment of the locking pliers of the invention showing the force vectors acting on the moveable jaw when the tool is torqued.
Figure 7:
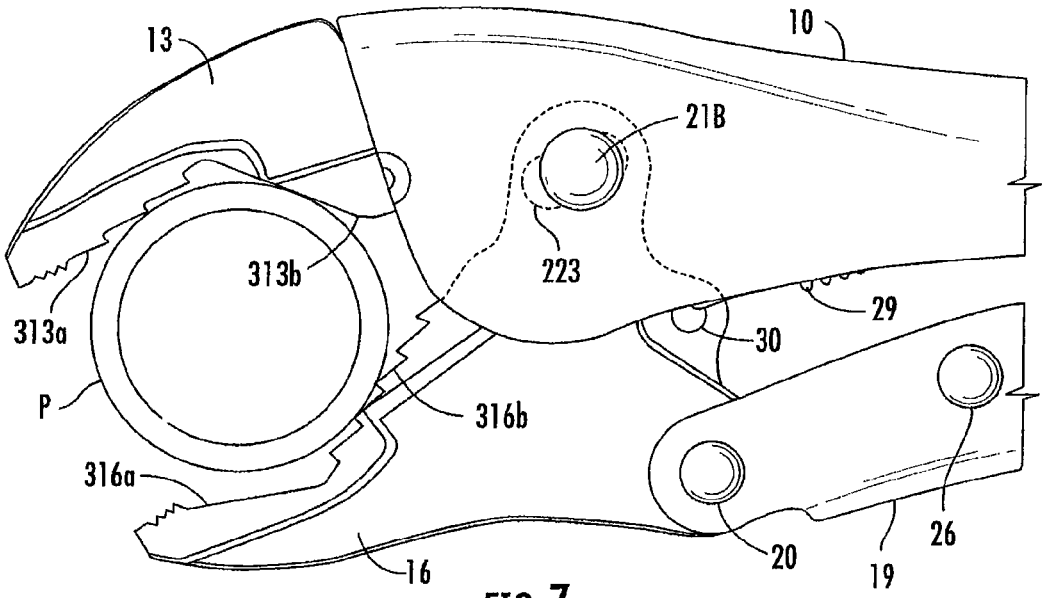
FIGS. 7 and 8 are partial side views of embodiments of the locking pliers similar to that shown in FIG. 6 locked on different size work pieces.
Figure 9:
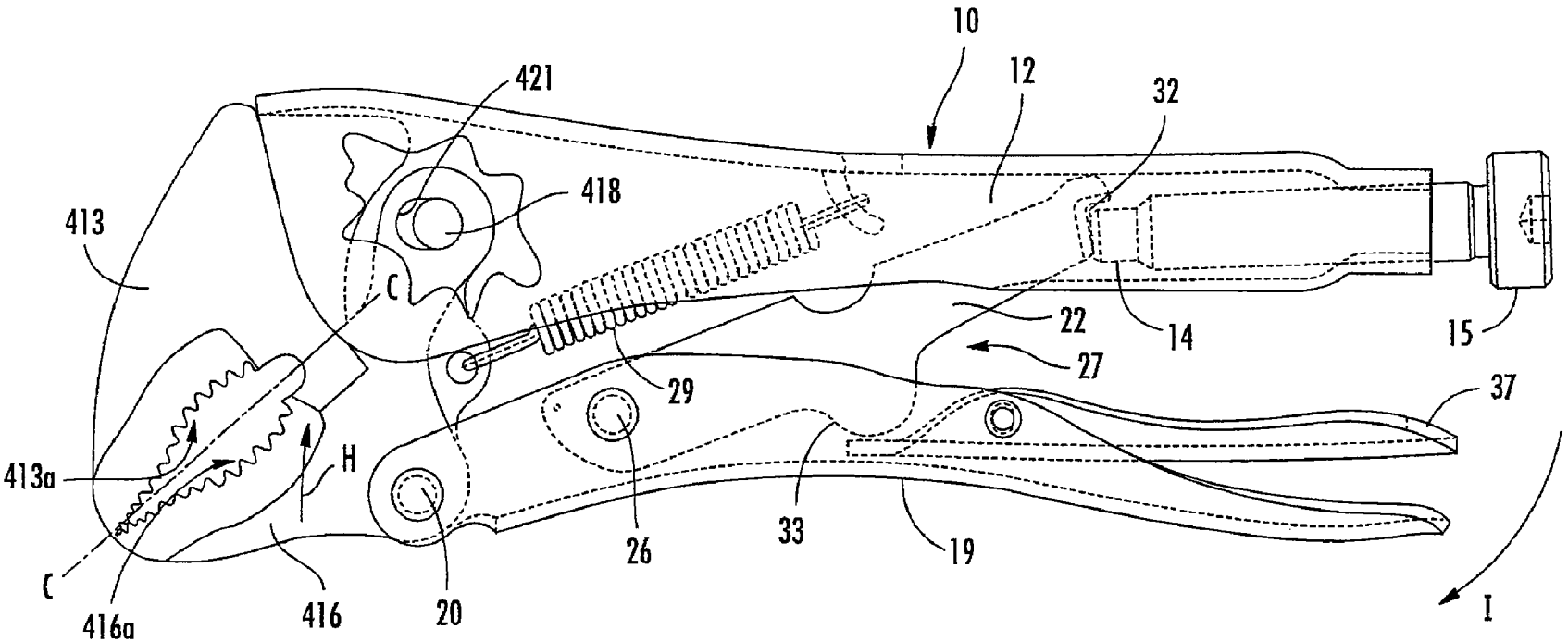
FIG. 9 is a partially cut-away side view of yet another embodiment of the locking pliers of the invention.
Figure 10:
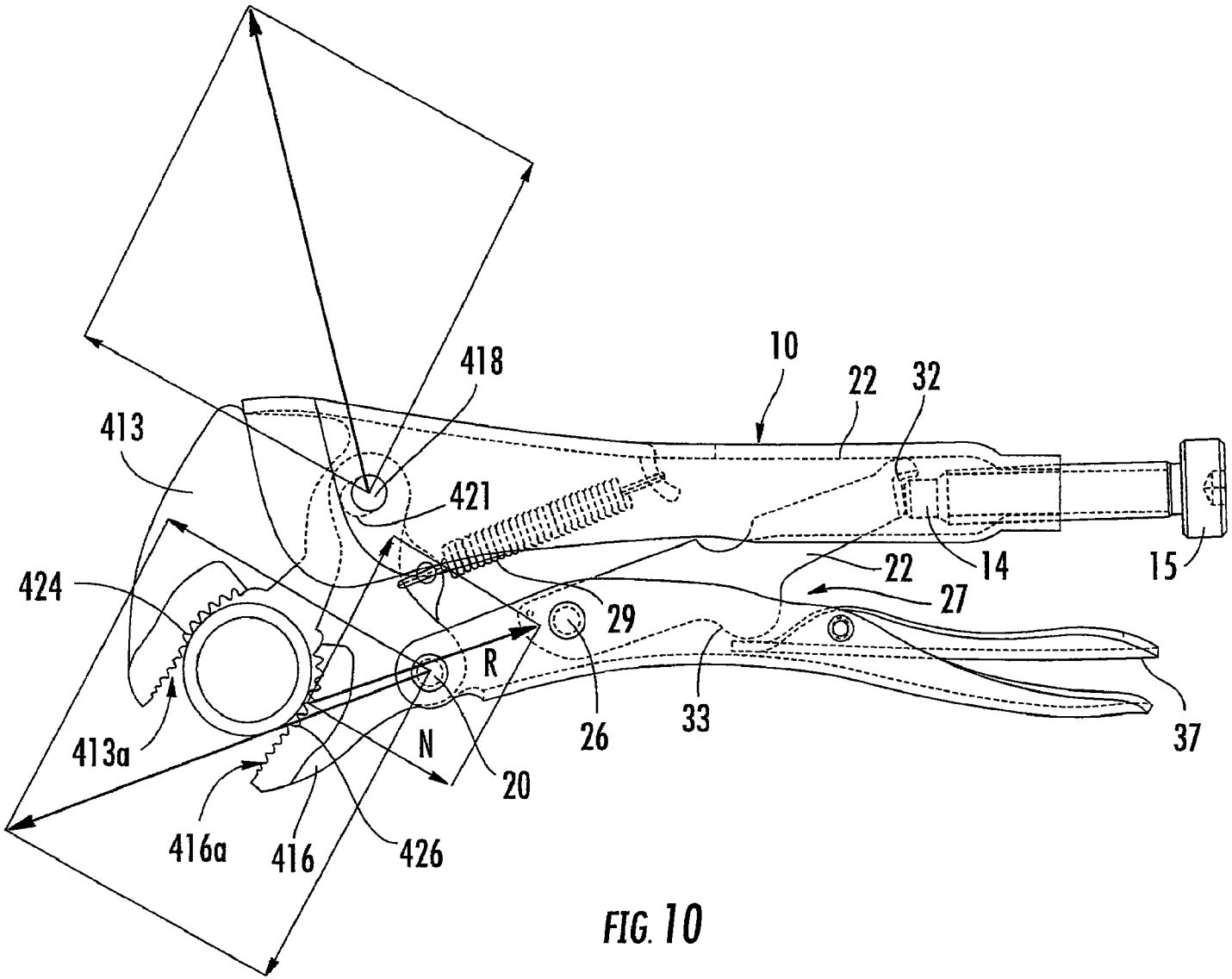
FIG. 10 is a side view of the embodiment of the locking pliers shown in FIG. 9 locked on a work piece showing the force vectors acting on the moveable jaw when the tool is torqued.

Referring to FIG. 6 an alternate embodiment of the locking pliers of the invention is shown. In the figures like reference numerals are used to identify like components previously described with respect to alternate embodiments. In the embodiment of FIG. 6 a quick release lever 37 is pivoted to handle 19 such that the end of the lever 37*a* can be depressed to pivot the opposite end 37*b* into linkage 22 to unlock the pliers. A quick release lever 37 is also shown in the embodiments of FIGS. 5, 9 and 10. A pivot pin 218 is retained in a fixed position relative to the fixed assembly 10 and an aperture 221 is formed in the movable jaw 316 and receives pivot pin 118. In this embodiment aperture 221 is formed as a circular aperture in jaw 316 having sufficient clearance between it and pin 218 to allow the locking pivoting movement of movable jaw 316. Referring to FIG. 7 a similar embodiment of the locking pliers is shown except that circular aperture 221 is replaced by an elongated slotted aperture 223.

The tight gripping effect of the jaws is most effective where the resultant force R on the movable jaw 316 from the work piece being gripped is inside of the pivot 20 of jaw 316. "Inside" means that the resultant force R on jaw 316 is between the pivot 20 and pin 18, 118 or 218 and toward the rear of the pliers. In a typical application the resultant force R on jaw 16 is located just inside of the pivot 20. If the resultant force on jaw 316 is inside of the pivot 20, the force on the jaw 316 tends to force the jaw 316 towards the rear of the pliers such that the jaw 316 will tend to pivot clockwise as viewed in the figures. The tendency of the jaw 316 to pivot about pin 20 toward jaw 13 creates the tight grip effect as previously described.

In FIG. 6 this effect is accomplished using V-shaped jaws. Specifically, fixed jaw 313 includes a first jaw face 213*a* and a second jaw face 213*b* arranged at an angle relative to one another such that the work piece P is received in the joint between the two faces. The movable jaw 316 is also formed as a V-shape having two jaw faces 216*a* and 216*b* arranged at an angle relative to one another and meeting at joint 216*c*. Positive torque face 216*b* contacts the work piece during the torquing of the tool while the reverse torque face 216*a* is not in contact with the work piece. As a result, the resultant force R on the movable jaw 316 is applied only to the positive torque jaw face 216*b*. By angling the jaw face 216*b* relative to the pivot pin 20 the configuration of the jaws ensures that the resultant force R on the movable jaw 316 is inside of pivot 20. In order to direct the resultant force R inside of pivot 20, the face 216*b* is angled such that the normal force N on the movable jaw is near pivot 20. By changing the angle of the positive torque face 216*b* the direction of the resultant force can be moved more or less to the inside of pivot 20.

The movable jaw 316 has the positive torque face 216*b* extending from the inner end of the jaw face near the pivot 218 to an approximate midpoint of the jaw 316 at joint 216*c*. The reverse torque face extends from the joint 216*c* to near the end of the jaw 316. Jaw faces 216*a* and 216*b* form a shallow V-shape with the inner joint of the V extending toward the work piece P. The fixed jaw 313 has the reverse torque face 213*b* extending from the inner end of the jaw face near the pivot 218 to an approximate midpoint of the jaw 313 at joint 213*c*. The positive torque face 213*a* extends from the joint 213*c* to near the end of the jaw 313. Jaw faces 213*a* and 213*b* also form a shallow V-shape with the inner joint of the V extending toward the work piece P and disposed approximately opposite to joint 216*c*.

Figure 8:
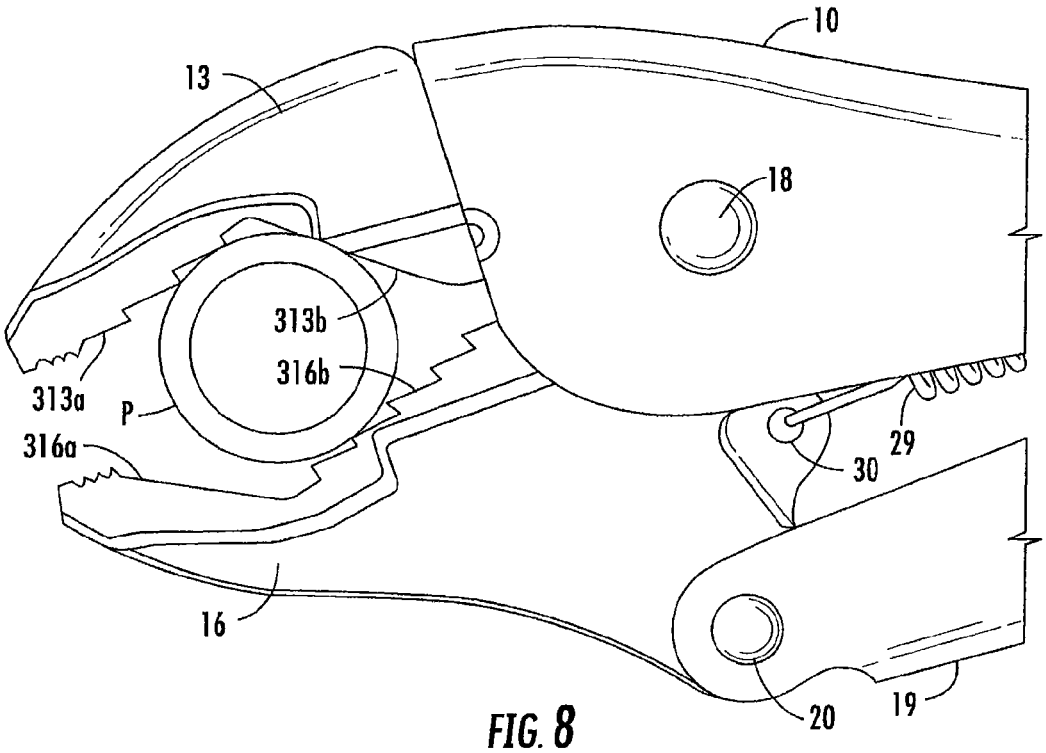

In the illustrated embodiment directional teeth 220 and 221 are formed on the positive torque faces 213*a* and 216*b* and non-directional teeth 224 and 226 are formed on the reverse torque faces 213*b* and 216*a*. In the illustration of FIG. 6 the pliers are turned in a clockwise direction as shown by arrow G. Directional teeth 220 and 221 are formed at an angle with respect to the plane of faces 213*a* and 216*b*, respectively, to positively engage the work piece P when the pliers are rotated in the direction of arrow G. The non-directional teeth 224 and 226 are formed such that the teeth extend substantially perpendicularly from the jaw faces 213*b* and 216*a*. FIG. 7 shows a similarly configured jaw to that shown in FIG. 6 except that the reverse torque faces 313*b* and 316*a* are formed without teeth. FIG. 8 shows the same arrangement of the jaw faces locked on a smaller work piece.

The jaw structure shown in FIGS. 6 and 7 also allows the jaws to operate as ratcheting jaws. When the jaws are lightly locked on a work piece as shown in FIGS. 6 and 7 and a torque is applied in the direction of arrow G, the movable jaw 16 moves toward jaw 13 to tighten the grip as previously described. When movement of the pliers is reversed (moved opposite arrow G), the movable jaw 316 is no longer forced toward the fixed jaw such that the directional teeth 220 and 221 can slip over the work piece and the pliers can rotate relative to the work piece P without the linkage 27 being opened or the screw 14 being loosened. The pliers can then be rotated in the direction of arrow G to tightly grip and rotate the work piece P. These steps can be repeated to provide a ratchet effect.

Referring to FIGS. 9 and 10, the tight gripping effect is accomplished using drop-nose jaws rather than by angling the jaw faces relative to the jaws as previously described. Drop nose jaws include a fixed jaw 413 and a movable jaw 416. Movable jaw 416 includes a slotted aperture 421 for receiving the pin 418 to allow the pin to move relative to the slotted aperture to allow jaw 416 to pivot towards jaw 413. Pin 418 is stationary and is fixed in position on fixed assembly 10. Fixed jaw 413 includes a jaw face 413*a* and movable jaw 416 is formed with a jaw face 416*a*. The jaws 413 and 416 are disposed such that the jaws are angled down relative to the fixed assembly 10. Specifically, a line C-C extending between the jaws is disposed at an angle relative to the fixed assembly such that the jaw faces 413*a* and 416*a* are angled relative to the pliers. By angling the jaws 413 and 416 and jaw faces 413*a* and 416*a* relative to the pivot pin 20 the jaws are configured to ensure that the resultant force R on the movable jaw 416 is inside of pivot 20 as shown in FIG. 10. In order to direct the resultant force R inside of pivot 20, the jaws are angled such that the normal force N on the movable jaw is near pivot 20. In the illustrated embodiment, non-directional teeth 424 and 426 are formed on both jaw faces 413*a* and 416*a*. The non-directional teeth shown in FIGS. 9 and 10 may be replaced by directional teeth such as shown in the embodiment shown in FIG. 6.

The jaw faces 413*a* and 416*b* of the fixed jaw and movable jaw are angled and dimensioned such that the resultant force on the movable jaw is inside of pivot 20. With the resultant force inside of the pivot 20 the movable jaw will rotate about pivot 20 as shown by arrow H (FIG. 9) toward the fixed jaw 413 when the jaws are locked on a work piece and a torque is applied in the direction of arrow I. This movement of the movable jaw 413 during application of a torque provides the grip tightening effect of the pliers of the invention as previously described.

Specific embodiments of an invention are disclosed herein. One of ordinary skill in the art will recognize that the invention has other applications in other environments. Many embodiments are possible. The following claims are in no way intended to limit the scope of the invention to the specific embodiments described above.

The invention claimed is:

1. A lockable pliers comprising:

a fixed assembly comprising a first handle supporting a first jaw;

a second jaw movable relative to the first jaw between an open position and a closed, locked position;

a second handle movable relative to the first handle, said second handle connected to the second jaw at a fixed pivot;

a locking mechanism for locking the second jaw in the closed, locked position;

a movable pivot connecting the second jaw to the fixed assembly such that the movable pivot can move relative to the fixed assembly and the second jaw can move toward the first jaw when the second jaw is in the closed, locked position on a workpiece and a torque is applied to the pliers; and the second jaw being configured such that a resultant force on the second jaw from the workpiece is inside of the fixed pivot to move the second jaw toward the first jaw.

2. The locking pliers of claim 1 wherein the first jaw includes a first jaw face and a second jaw face arranged at an angle relative to one another such that the work piece may be received in a joint between the first jaw face and the second jaw face.

3. The locking pliers of claim 2 wherein the second jaw face is formed without teeth.

4. The locking pliers of claim 1 wherein the second jaw is formed as a V-shape.

5. The locking pliers of claim 1 wherein the second jaw has a third jaw face and a fourth jaw face arranged at an angle relative to one another.

6. The locking pliers of claim 5 wherein the third jaw face and fourth jaw face are configured such that when the tool is locked on a workpiece the third jaw face does not contact the workpiece and the fourth jaw face contacts the work piece during the torquing of the tool.

7. The locking pliers of claim 6 wherein directional teeth are formed on the fourth jaw face, the directional teeth being formed at an angle with respect to the plane of the fourth jaw face.

8. The locking pliers of claim 7 wherein non-directional teeth are formed on the third jaw face, the non-directional teeth being formed such that the teeth extend substantially perpendicularly from the third jaw face.

9. The locking pliers of claim 5 wherein the third jaw face and fourth jaw face are configured such that a resultant force on the second jaw is applied only to the fourth jaw face.

10. The locking pliers of claim 5 wherein the fourth jaw face is configured such that a normal force on the fourth jaw face is directed near the fixed pivot.

11. The locking pliers of claim 1 wherein said movable pivot comprises a pivot pin connected to one of said fixed assembly and said second jaw and located in an aperture in the other one of the fixed assembly and the second jaw wherein the pivot pin can move in said aperture such that when the pivot pin moves in said aperture the second jaw is moved toward the first jaw.

12. The locking pliers of claim 11 wherein said pivot pin is normally located in the aperture slot towards the front of the pliers.

13. The locking pliers of claim 12 wherein the pivot pin moves toward the rear of the pliers when a torque is applied to the pliers.

14. A method of gripping a workpiece with a locking pliers comprising:

providing a fixed assembly comprising a first handle supporting a first jaw;

providing a second jaw movable relative to the first jaw between an open position and a closed, locked position;

providing a second handle movable relative to the first handle, said second handle connected to the second jaw at a fixed pivot;

providing a locking mechanism for locking the second jaw in the closed, locked position;

providing a movable pivot connecting the second jaw to the fixed assembly;

locking the first jaw and second jaw on a workpiece using the locking mechanism;

applying a torque to the pliers in a first direction such that a resultant force is applied on the second jaw by the workpiece;

allowing the movable pivot to move relative to the fixed assembly and the second jaw to move toward the first jaw when the second jaw is in the closed, locked position on a workpiece and the torque is applied to the pliers in the first direction as a result of the resultant force applied to the second jaw.

15. A lockable pliers comprising:

a fixed assembly comprising a first handle supporting a first jaw wherein the first jaw includes a first jaw face and a second jaw face arranged at an angle relative to one another such that a work piece may be received in a joint between the first jaw face and the second jaw face;

a second jaw movable relative to the first jaw between an open position and a closed, locked position wherein the second jaw has a third jaw face and a fourth jaw face arranged at an angle relative to one another, the third jaw face and fourth jaw face being configured such that when the jaws are locked on a workpiece the third jaw face does not contact the workpiece and the fourth jaw face contacts the work piece during the torquing of the tool;

a second handle movable relative to the first handle, said second handle connected to the second jaw at a fixed pivot;

a locking mechanism for locking the second jaw in the closed, locked position;

a movable pivot connecting the second jaw to the fixed assembly comprising a pivot pin connected to one of said fixed assembly and said second jaw and located in an aperture in the other one of the fixed assembly and the second jaw such that the pivot pin can move in said aperture when the second jaw is in the closed, locked position on a workpiece and a torque is applied to the pliers, such that when the pivot pin moves in said aperture the second jaw is moved toward the first jaw.

16. The locking pliers of claim 15 wherein the third jaw face and fourth jaw face are configured such that a resultant force on the second jaw is applied inside of the fixed pivot.

17. The locking pliers of claim 15 wherein directional teeth are formed on the first jaw face and the fourth jaw face, the directional teeth being formed at an angle with respect to the plane of the first jaw face and the fourth jaw face.

* * * * *